United States Patent [19]

Bailie

[11] Patent Number: 4,924,895

[45] Date of Patent: May 15, 1990

[54] AWNING COVER

[75] Inventor: David A. Bailie, Kent, Wash.

[73] Assignee: The Fisher Group Inc., Ann Arbor, Mich.

[21] Appl. No.: 243,314

[22] Filed: Sep. 12, 1988

[51] Int. Cl.[5] ..... E04H 15/08

[52] U.S. Cl. ..... 135/89; 160/67

[58] Field of Search ..... 160/67, 70, 392, 394, 160/395; 135/89

[56] References Cited

U.S. PATENT DOCUMENTS 3,302,260 2/1967 Cuddeback ..... 160/392

*Primary Examiner*—Henry E. Raduazo

*Attorney, Agent, or Firm*—Christensen, O'Connor, Johnson & Kindness

[57] ABSTRACT

A cover adapted to surround and protect a fabric awning when rolled to the stored position. In a preferred embodiment, a flexible sheet metal strip is mounted directly on the awning, on the upper surface thereof, generally adjacent the structure on which the awning is mounted. The metal sheet covers a laterally extending segment of the awning such that, when the awning is rolled, the metal sheet is rolled over the outer surface of the rolled awning. The metal sheet is mounted on the awning by means of interconnecting members positioned on opposite sides of the awning surface which, when engaged, capture and hold a portion of the awning without perforating it.

9 Claims, 4 Drawing Sheets

AWNING COVER

FIELD OF THE INVENTION

This invention relates, in general, to protective covers for awnings and, in particular, to a cover of a type that is mounted directly on the awning and may thus be used not only with new awnings, but also may easily be retrofit to already installed awnings. The awning cover is preferably made of flexible sheet metal and is particularly adapted for use with the awnings of recreational vehicles.

BACKGROUND OF THE INVENTION

It has long been known that storing a rolled-up fabric awning in a protective enclosure extends both the life and appearance of the awning. Such protective covers may comprise a box-like structure mounted on the building or recreational vehicle on which the awning is hung or may be incorporated into the awning itself. The latter type is particularly used with recreational vehicles where the awning is generally rolled onto a spring-wound storing core usually referred to as a roller tube, the roller tube customarily being located at the outer end of the awning and adapted to wind toward the recreational vehicle to which it is attached until the entire awning is wound onto the roller tube and is positioned adjacent the side of the recreational vehicle. As such, that portion of the awning that constitutes the last layer of the awning to be wound onto the roller tube serves as a cover for the remainder of the awning when so stored.

U.S. Pat. No. 4,331,169 discloses an awning including a plastic laminate structure positioned at the inner end of the awning to provide a dimensionally stable plastic awning cover. U.S. Pat. No. 4,180,117 discloses the use of a heavy-duty fabric to serve as a cover for the awning when fully rolled to the closed position.

U.S. Pat. No. 3,826,271 discloses an awning in which a fabric member serves as the major portion of the awning and a flexible and pliable thermoplastic sheet is joined to the inner edge of the fabric to act as a portion of the awning during normal use and as a cover when the awning is rolled for storage. U.S. Pat. Nos. 3,324,869, 4,576,192, and 4,634,172 all disclose awnings wherein metal members are joined to the inner edge of the fabric so that the metal cover member serves as a portion of the awning during normal use and serves as a protective cover for the fabric portion when the awning is rolled up and stored. The '869 patent discloses the use of stainless spring sheet steel riveted to the inner edge of the fabric awning. The '192 patent discloses the use of a flexible metal cover in the form of a number of strips secured to the inner end of the fabric awning. In the former configuration, the riveting of the metal to the fabric and the consequent perforation of the fabric creates potential ripping and leakage problems. The structure of the '192 patent allows for the possibility of leakage of water between the awning and the trailer. The invention of the '172 patent attempted to solve this leakage problem through use of a waterproof connector between the vehicle and the metal cover.

SUMMARY OF THE INVENTION

The present invention provides a cover for a fabric awning that is mounted directly on the fabric awning rather than being connected to the inner edge of the fabric awning to form a portion of the awning itself as is known in the prior art. The awning cover is preferably made of metal, but plastic or other suitable materials may be used. The awning cover of the present invention creates no leakage problems since the waterproof fabric awning remains integral and unperforated and extends from its mounting in the awning rail on a building or recreational vehicle to the roller bar. The awning cover of the present invention may be added to a fabric awning at the time of the awning's manufacture or at the time the awning is installed on a building or recreational vehicle. Alternatively, the awning cover of the present invention may also be added to an already installed awning.

The technique for mounting the awning cover on the fabric awning is simple to carry out and, in general, involves the interconnection of mating members positioned adjacent each other on opposite surfaces of the fabric awning to grip a portion of the awning therebetween to hold the awning cover in place.

DETAILED DESCRIPTION OF THE INVENTION

Figure 1:
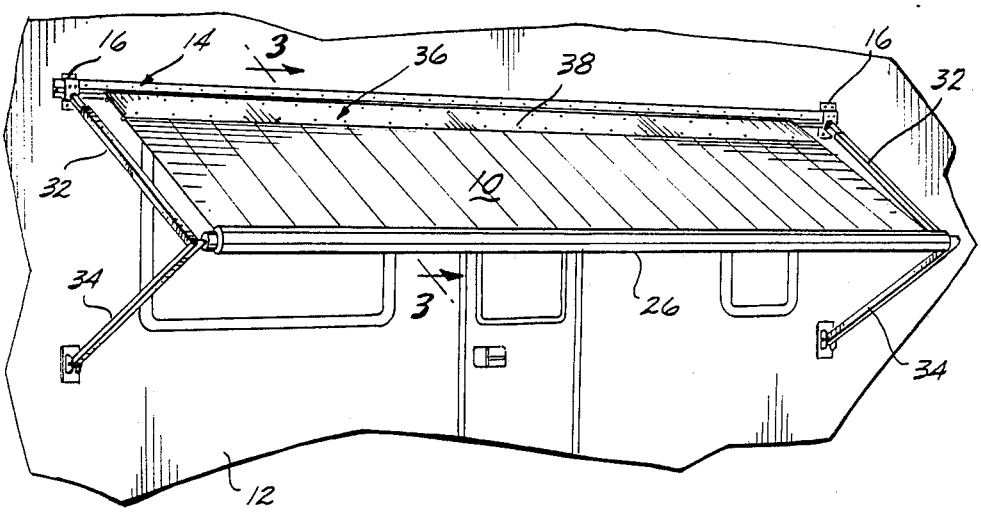
FIG. 1 is a perspective view of a typical awning including the awning cover of the present invention, the awning being mounted above a window.
Figure 2:
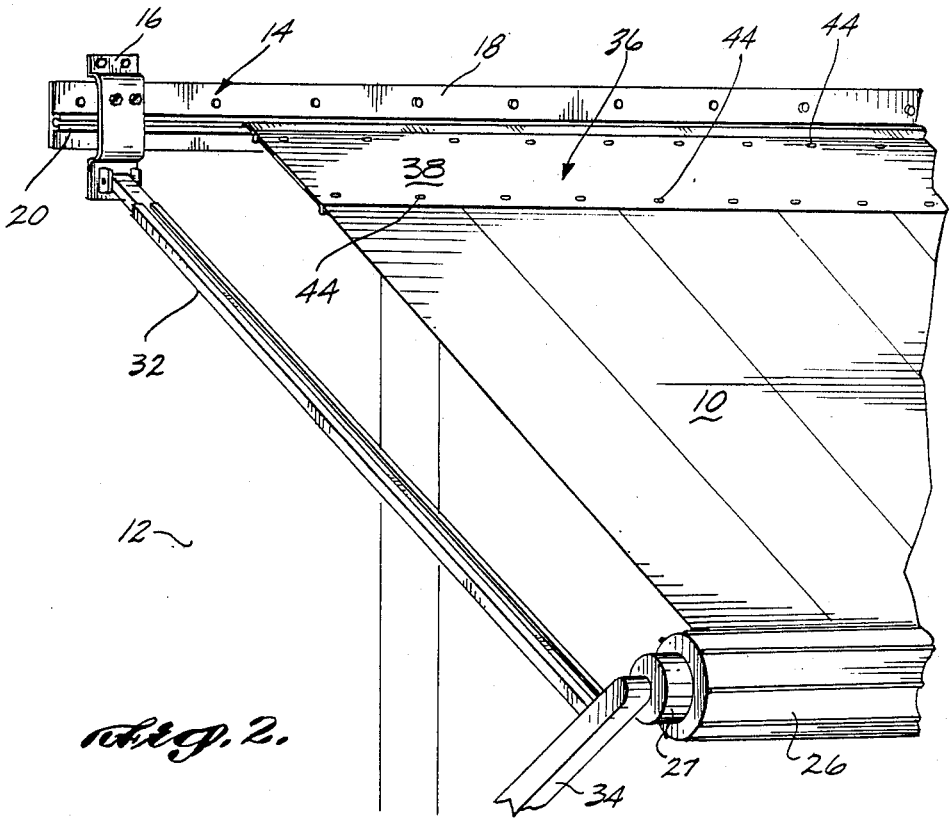
FIG. 2 is an enlarged partial perspective view of the awning and metal awning cover shown in FIG. 1.
Figure 3:
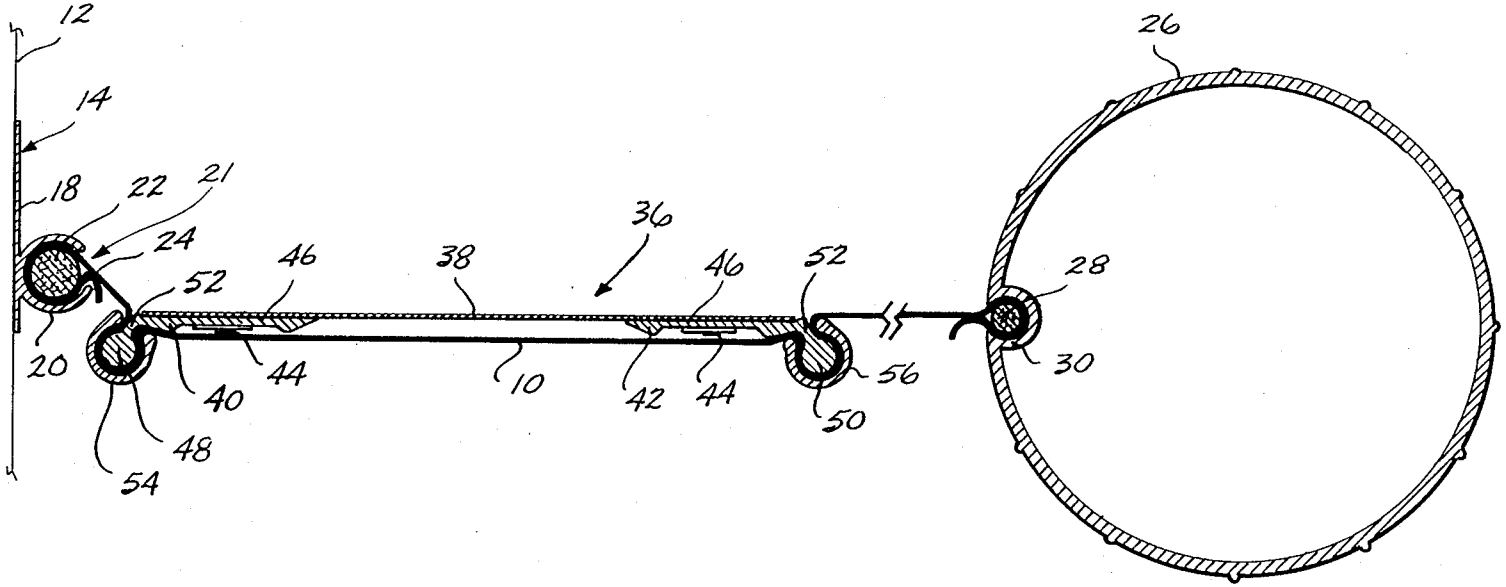
FIG. 3 is a sectional side elevation view of the awning cover of the present invention taken along line 3—3 of FIG. 1.

Referring initially to FIGS. 1 and 2, a conventional waterproof fabric awning 10 is shown mounted on the side of a recreational vehicle generally illustrated as 12. It will be understood that while the present invention is designed especially for use in connection with awnings mounted on recreational vehicles, the protective awning cover may also be used with fabric awnings mounted on homes or other buildings. Referring additionally to FIG. 3, the awning 10 is connected to the recreational vehicle or the like by means of an awning rail 14 that is mounted on the side of recreational vehicle 12 or a building by means of clamps 16 or other conventional fasteners. Awning rail 14 includes a mounting plate portion 18 that is adapted to be positioned against the wall of the recreational vehicle or building on which the awning is mounted, and a channel portion 20 in which the fabric awning 10 is held. Channel 20 includes a longitudinal opening 21 through which the awning extends.

As is best shown in FIG. 3, awning 10 is held in the awning rail channel 20 by wrapping the end of the awning around a welt cord 22 or the like, and then sewing the awning back upon itself along line 24 to hold the welt cord in place to form a welt. The welt is typically inserted in the channel portion of the awning rail by sliding it into the open end of the channel. It has been found that sanding or flaring the end of the channel eases the positioning of the awning welt therein. As shown, the diameter of the welt is provided to be larger than the opening 21 in the awning rail channel through which the awning extends, and thus the welt cannot readily be pulled through this opening and the awning is held firmly in place and a waterproof connection between the awning rail and the awning is formed.

A conventional roller tube 26, typically formed of aluminum and including a spring wound core 27, is shown connected to the outer end of the awning 10. As illustrated, the connection between the awning and the roller tube is again by means of a welt cord 28 sewn into the edge of the awning and then slipped within open channel 30 formed in the surface of the roller tube. Again, the welt is larger in diameter than the opening of the channel 30, thus forming a firm connection between the awning and the roller tube.

Roller tube 26 is shown supported in its extended position by means of a pair of rafter arms 32 extending generally outwardly from the awning rail supports 16 and cooperating upwardly extending support arms 34. The awning rafter arms and support arms are all conventional and will not be described in detail other than to indicate that they function to support the outer end of the awning when the awning is in its open or unrolled position and are mounted to pivot and slide with respect to each other to a generally vertical position adjacent the wall of the recreational vehicle 12 when the awning is rolled for storage.

FIGS. 1 and 2 illustrate that the awning cover 36 of the present invention is positioned upon the fabric awning 10 adjacent its inner edge connection to awning rail 14. Referring additionally to FIG. 3, the awning cover includes an awning guard portion 38 which preferably comprises a generally rectangular sheet of thin, flexible stainless steel. In one embodiment, it has been found satisfactory to use a sheet stainless steel formed of a No. 304 alloy and having a thickness of 0.005 inches. If desired, the surface texture of the metal may be embossed to better hide abrasions. Since the purpose of an awning cover is to protect the stored fabric awning against not only the effects of sunlight, but also contact abrasions, it has been found that sheet stainless steel very satisfactorily protects the awning against abrasions or rips that may occur when the recreational vehicle mounted awning is driven into contact with tree branches or the like. It will be understood, however, that any material, including plastic of a flexible and durable nature, or interleaved aluminum panels may satisfactorily be employed in accordance with the teachings of the present invention.

Figure 4:
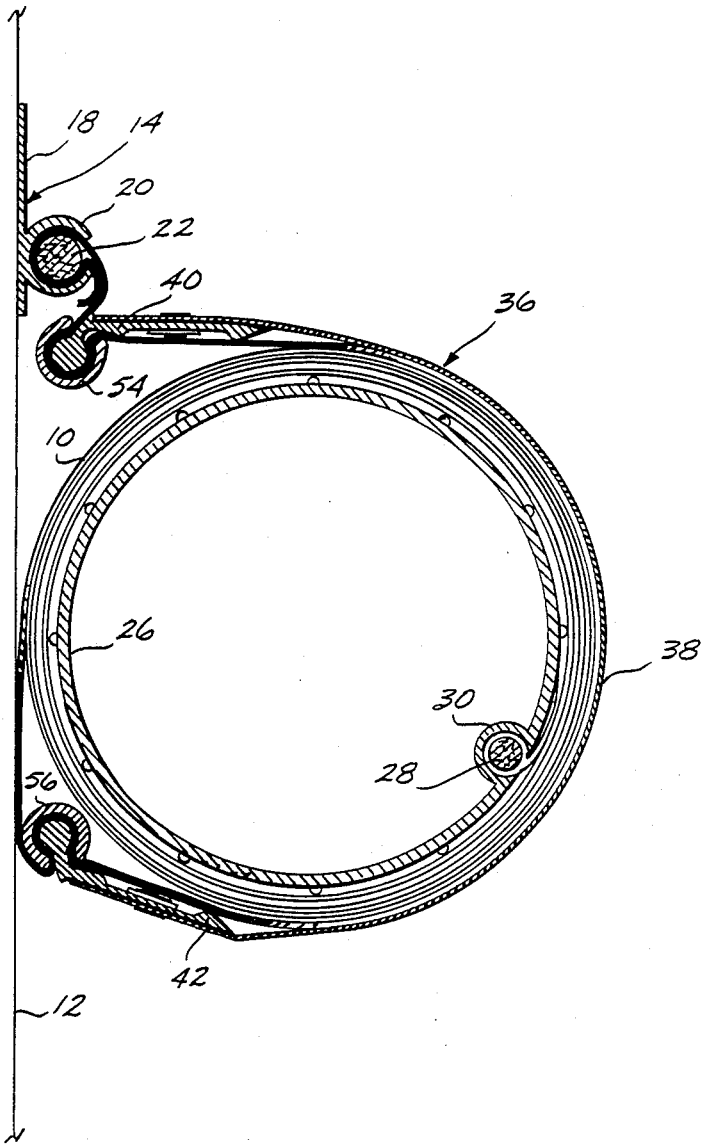
FIG. 4 is a side elevation view of the awning and awning cover of FIG. 3 shown rolled for storage.

As illustrated in FIGS. 1 and 2, awning guard 38 is generally rectangular and extends substantially from one lateral edge of the awning to the other such that when the awning is rolled, the entire width of the awning is covered by the awning guard in a manner to be described hereafter. Referring also to FIG. 4, it will be seen that the length of the awning guard is such that when the awning is rolled for storage, the awning guard substantially covers the exposed surface of the rolled awning. In FIG. 4, the awning guard is shown as extending from immediately adjacent the awning rail 14 around the rolled awning to a point adjacent recreational vehicle wall 12. It will be understood that the lateral length of the awning guard may be varied as desired to cover a greater or lesser portion of the circumference of the rolled awning. In general, however, it is preferred that the awning guard cover a substantial portion of the exposed surface of the fabric awning when rolled, such as is shown in FIG. 4.

Referring specifically to FIG. 3, awning guard 38 is shown to include a first connector means 40 mounted along the inner edge of the awning guard and a second identical connector means 42 mounted along the outer edge of the awning guard. Connectors 40 and 42 may be riveted to the awning guard by means of conventional stainless steel rivets 44, but it will be understood that any conventional fastening means, including adhesive, may be used to join these connectors to the awning guard. Since these fasteners do not perforate the fabric awning, watertight fasteners need not be used. However, it has been found desirable to place a foam pad or other soft material covering (not shown) on the surface of rivet 44 adjacent fabric awning 10 to protect the awning surface from wear.

Connectors 40 and 42 include a plate portion 46 through which the rivets 44 or other fastening means may be disposed and outwardly extending beads or rails 48 and 50 that are adapted to rest upon the upper surface of fabric awning 10. As illustrated, rails 48 and 50 are integrally connected to plate 46 via narrowed neck portion 52. As is best shown in FIG. 3, rails 48 and 50 are adapted to be pressed into the fabric awning such that the awning conforms generally to the surface of the rails.

Retaining channels 54 and 56 are positioned on the opposite side of the fabric awning 10 from awning guard 38 and are adapted to slide over rails 48 and 50, respectively, to capture a portion of the fabric awning therebetween. In this manner, the awning cover is releasably secured in place on the surface of fabric awning 10 without any perforation of the fabric material. Retaining channels 54 and 56 are generally C-shaped and include a narrow opening adjacent the necks 52 of the connectors which thus prevent the rails 48 and 50 from being disengaged therefrom other than by sliding the retaining channel off of the end of the rail.

Figure 5:
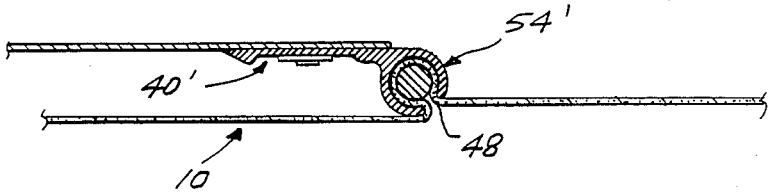
FIG. 5 is a partial sectional side elevation view of an alternative awning cover of the present invention.

While it is preferred to affix the rail connector to the awning guard in the manner illustrated in FIG. 3, it is also contemplated that a retaining channel 54′ could be formed on a connector 40′ and that a rail 48′ could be positioned on the opposite side of the awning 10 to form the cooperating means for gripping the awning fabric as depicted in FIG. 5. It is also contemplated that other forms of interconnectible structures adapted to be positioned on opposite sides of the fabric awning to grip it and, thus, hold the awning guard in place may be used and are considered to be within the scope of this invention.

Although the present invention has been disclosed with respect to several preferred embodiments and modifications thereto, further modifications will be apparent to those skilled in the art. Accordingly, it is not intended that the invention be limited by the disclosure or by such modifications, but instead that its scope should be determined entirely by reference to the claims which follow hereinbelow.

The embodiments of the invention in which an exclusive property or privilege is claimed are defined as follows:

1. A cover for an awning adapted to be rolled for storage and unrolled during use comprising:

a generally rectangular awning guard having a length substantially equal to the exposed circumference of the awning when rolled, a width equal to the width of the awning, a pair of laterally extending edges, and a pair of longitudinally extending edges generally parallel to side edges of the unrolled awning; and a pair of two-piece connectors separated by a distance substantially equal to said awning guard lateral length, one piece of each said connectors attached to said awning guard adjacent a separate one of said awning guard laterally extending edges, each said connector adapted to secure the awning to said awning guard without perforating the awning.

2. The cover of claim 1 wherein said connectors comprise a pair of rail and channel assemblies, each said assembly including a rail attached to said awning guard adjacent one of said awning guard laterally extending edges and extending parallel thereto such that the awning is adjacent said rail, and a retaining channel means adapted to secure the awning against said rail without perforating the awning.

3. The cover of claim 1 wherein said connectors comprise rail and channel assemblies, each said assembly including a retaining channel means attached to said awning guard adjacent one of said awning guard laterally extending edges and extending parallel thereto such that the awning is adjacent said retaining channel means, and a rail adapted to secure the awning in said retaining channels without perforating the awning.

4. A cover for an awning adapted to be rolled for storage and unrolled during use comprising:

a generally rectangular awning guard having a length substantially equal to the exposed circumference of the awning when rolled for storage, a width equal to the width of the awning, a pair of laterally extending edges, and a pair of longitudinally extending edges generally parallel to side edges of the unrolled awning; and means for mounting said awning guard over the awning including a pair of opposed rail means integral with said awning guard located adjacent said awning guard laterally extending edges, separated by a distance substantially equal to said awning guard lateral length, and located against the awning, and a pair of retaining channel means, each of said retaining channel means positioned against the awning opposite of one said rail means and adapted to grip the awning against said rail means without perforating the awning.

5. The cover of claim 4 wherein said awning guard comprises a thin sheet of flexible metal.

6. The cover of claim 4 wherein said awning guard comprises a sheet of stainless steel having a thickness of approximately 0.005 inches.

7. An awning assembly comprising:

an awning adapted to be rolled and unrolled having a first lateral end adapted to be secured to a stationary member, a second lateral end opposite said first lateral end adapted to be secured to a roller tube and a unitary body of substantially uniform thickness extending between said lateral ends;

a generally rectangular awning guard over said awning adjacent said awning first lateral end having a length substantially equal to the exposed circumference of said awning when rolled, a width equal to the width of said awning, a pair of laterally extending edges, and a pair of longitudinally extending edges generally perpendicular to side edges of said awning; and a pair of two-piece connectors separated by a distance substantially equal to said awning guard lateral length, one piece of each connector attached to said awning guard adjacent a separate one of said awning guard laterally extending edges, each said connector adapted to secure the awning to said awning guard without perforating the awning.

8. The awning assembly of claim 7 wherein each said connector comprises a rail and channel assembly including a rail integral with said awning guard located adjacent one of said awning guard laterally extending edges and extending substantially parallel thereto such that said awning is adjacent said rail, and a retaining channel means adapted to secure the awning against said rail without perforating the awning.

9. The awning assembly of claim 7 wherein each said connector means comprises a rail and channel assembly including a retaining channel integral with said awning guard, and located adjacent one of said awning guard laterally extending edges and substantially parallel thereto such that said awning is adjacent said retaining channel, and a rail adapted to secure said awning in said retaining channel without perforating said awning.

* * * * *

UNITED STATES PATENT AND TRADEMARK OFFICE

CERTIFICATE OF CORRECTION

PATENT NO. : 4,924,895

DATED : May 15, 1990

INVENTOR(S) : David A. Bailie

It is certified that error appears in the above-identified patent and that said Letters Patent is hereby corrected as shown below:

In claim 7, column 6, line 19, replace "perpendicular" with --parallel--.

Signed and Sealed this

Fourth Day of July, 1995

Bruce Lehman

*Attest:*

BRUCE LEHMAN

*Attesting Officer*

*Commissioner of Patents and Trademarks*